US011884429B2

(12) United States Patent
Pattuzzi et al.

(10) Patent No.: US 11,884,429 B2
(45) Date of Patent: Jan. 30, 2024

(54) METHOD AND MACHINE FOR PACKAGING PRODUCTS IN WRAPPING SHEETS

(71) Applicant: Korber Tissue S.p.A., Lucca (IT)

(72) Inventors: Fabio Pattuzzi, Bologna (IT); Livio Paganini, Lucca (IT); Daniele Scannavini, Lucca (IT); Andrea Degli Esposti, Lucca (IT); Piero Di Buono, Lucca (IT)

(73) Assignee: Korber Tissue S.p.A., Lucca (IT)

( * ) Notice: Subject to any disclaimer, the term of this patent is extended or adjusted under 35 U.S.C. 154(b) by 0 days.

(21) Appl. No.: 17/627,906

(22) PCT Filed: Jul. 17, 2020

(86) PCT No.: PCT/EP2020/070255
§ 371 (c)(1),
(2) Date: Jan. 18, 2022

(87) PCT Pub. No.: WO2021/009339
PCT Pub. Date: Jan. 21, 2021

(65) Prior Publication Data

US 2022/0258889 A1 Aug. 18, 2022

(30) Foreign Application Priority Data

Jul. 18, 2019 (IT) ..... 102019000012273

(51) Int. Cl.
*B65B 11/22* (2006.01)
*B65B 41/00* (2006.01)

(52) U.S. Cl.
CPC ..... *B65B 11/22* (2013.01); *B65B 41/00* (2013.01)

(58) Field of Classification Search
CPC ..... B65B 41/00; B65B 11/22; B65B 25/146; B65B 59/001; B65B 11/20; B65B 49/08; B65B 51/14
See application file for complete search history.

(56) References Cited

U.S. PATENT DOCUMENTS 2,890,555 A * 6/1959 Hayssen ..... B65B 11/22 53/385.1
5,287,679 A * 2/1994 Dall'Omo ..... B65B 51/16 53/375.9

(Continued)

FOREIGN PATENT DOCUMENTS

EP 2114772 B1 9/2010
WO 2009078051 A1 6/2009

(Continued)

*Primary Examiner* — Andrew M Tecco
*Assistant Examiner* — Nicholas E Igbokwe
(74) *Attorney, Agent, or Firm* — Breiner & Breiner, L.L.C.

(57) ABSTRACT

The machine for packaging groups of products in a wrapping sheet, includes a device for spreading a wrapping sheet and a handling device, adapted to reciprocally move a group of products to be packaged and the wrapping sheet, so as to wrap the wrapping sheet around the group of products as a result of the reciprocal movement between the wrapping sheet and group of products. The machine further includes temporary support members adapted to support flaps of the wrapping sheet protruding with respect to the group of products during a step of reciprocal movement between the group of products to be packaged and the wrapping sheet.

8 Claims, 8 Drawing Sheets

(56) References Cited

U.S. PATENT DOCUMENTS

| | | | | |
|---|---|---|---|---|
| 6,067,780 | A | 5/2000 | Gentili et al. | |
| 6,308,497 | B1 | 10/2001 | Cassoli et al. | |
| 8,430,232 | B2 | 4/2013 | Baldanza et al. | |
| 2002/0059778 | A1* | 5/2002 | Gamberini | B65B 11/20 53/128.1 |
| 2002/0059779 | A1* | 5/2002 | Gamberini | B65B 25/146 53/228 |
| 2005/0229538 | A1 | 10/2005 | Dall'Omo et al. | |
| 2014/0239590 | A1 | 8/2014 | Farrow | |
| 2014/0260087 | A1 | 9/2014 | Antoniazzi et al. | |
| 2015/0251785 | A1 | 9/2015 | Canini et al. | |

FOREIGN PATENT DOCUMENTS

| | | | |
|---|---|---|---|
| WO | 2018069781 | A1 | 4/2018 |
| WO | 2018210697 | A1 | 11/2018 |
| WO | 2018234399 | A1 | 12/2018 |

* cited by examiner

METHOD AND MACHINE FOR PACKAGING PRODUCTS IN WRAPPING SHEETS

TECHNICAL FIELD

Disclosed herein are methods and machines for packaging products in wrapping sheets, for example in sheets of plastic film or paper.

BACKGROUND ART

In many industrial fields, it is common to package products in wrapping sheets, for example, but not exclusively, sheets of plastic, i.e., polymeric, film.

Typically, packages of products in wrapping sheets are used in the field of tissue paper products. For example, packages of paper handkerchiefs and paper napkins, rolls of toilet paper, rolls of kitchen towels and the like are packaged in wrapping sheets.

For this purpose, the products are usually assembled in groups of products ordered according to a specific distribution. The groups of products are then wrapped in a wrapping sheet with aid of mechanical members, which act on the wrapping sheet, folding it around the group of products.

In some known machines, each group of products is arranged on an elevator, which moves according to a trajectory approximately orthogonal to a geometric plane at which a wrapping sheet is preliminarily spread. The relative movement between the wrapping sheet and the group of products causes the wrapping sheet to wrap around lateral surfaces of the group of products. Two opposite surfaces of the group of products remain free. The wrapping sheet has a dimension such as to protrude on two opposite sides of the group of products, i.e., from the aforesaid opposite surfaces, forming flaps. These flaps are subsequently folded by folding members against the opposite surfaces previously left free. The folded flaps are then stabilized in a folded position, for example by welding, gluing or other methods, for example applying an adhesive sheet thereto.

Examples of packaging machines of this type are disclosed in U.S. Pat. No. 6,308,497; WO2009/078051; U.S. Pat. No. 8,430,232; US2014/0260087; US2014/0239590; US2015/0251785; WO2018/234399; WO2018/069781; WO2018/210697.

For lines that produce articles or products to be packaged in the aforesaid manner, there is a constant research into technical solutions adapted to increase the productivity of the production lines, in which the packaging machines are included. This leads to the need to produce increasingly fast packaging machines, which also ensure the quality of the package produced.

Moreover, wrapping sheets are usually made of polymer or paper material. To reduce production costs and also to reduce the environmental impact of the materials used for packaging, there is constant research aimed at reducing the amount of polymer material used for packaging. Therefore, it would be useful to be able to use wrapping sheets thinner than those currently used, in order to reduce the amount of polymer or of paper.

Operations to wrap the wrapping sheet around the lateral faces of the group of products become critical at high speeds. In fact, the higher the speed with which the wrapping sheet is wrapped around the group of products to be packaged is, the greater the risk of incorrect positioning of the sheet and of the formation of creases becomes. This adversely affects the finished product, which can cause the product to be discarded.

For example, in machines of the type disclosed in the aforementioned publications, it has been found that the wrapping sheet tends to fold or be arranged incorrectly, i.e., not aligned with the group of products, when the plastic film used for producing the wrapping sheet is too thin and/or when the production speed increases. This poses limits in terms of production speed. The tendency to reduce the thickness of the plastic film used for the wrapping sheets is also limited by the need to guarantee correct control of the wrapping sheet during the steps of a packaging cycle.

U.S. Pat. No. 2,890,555 discloses a machine and a method for packaging products in wrapping sheets, in which pneumatic members are used to facilitate the packaging operation. The machine and the method known from this document have not proved to be effective.

Consequently, there is the need to develop methods and packaging machines, which entirely or partly solve the problems of the state of the art. In particular, it would be beneficial to provide packaging methods and machines, in which there is improved control of the position of the wrapping sheet with respect to the group of products to be packaged, even at high production speeds and/or when particularly thin wrapping sheets are used.

SUMMARY

According to a first aspect, there is provided a method for producing a package of products wrapped in a wrapping sheet, which firstly comprises a first step in which a wrapping sheet is arranged on a plane. By this it is meant that the wrapping sheet is spread so as to be arranged approximately according to a plane, for example retained along parallel and opposite edges of the sheet. No physical supporting surface of the wrapping sheet is provided for this purpose. If necessary, bar shaped elements or similar can be provided to support some areas of the sheet, however leaving it lying freely in space in a central area thereof, so as to be able to carry out the subsequent steps described below. The method further comprises the step of positioning a group of products in front of the wrapping sheet. The step of arranging the sheet according to a plane and of arranging the products in front of it can take place simultaneously or in sequence, or in a manner partially temporally overlapping. What is important is that at the end of these two steps the sheet and the products to be packaged are one in front of the other and preferably the wrapping sheet above the products and spaced therefrom.

Next, the method provides for the step of moving the group of products and the wrapping sheet toward each other, with a movement approximately orthogonal to the plane of the wrapping sheet, so as to wrap lateral surfaces of the group of products in the wrapping sheet, leaving two opposite surfaces of the group of products free.

In the present context, movement between wrapping sheet and group of products is meant as a relative movement between said wrapping sheet and said group of products. For practicality and for better control, in currently preferred embodiments the wrapping sheet is arranged in a fixed position and the group of products is moved toward the wrapping sheet. This latter will then follow the group of products in its further movement, when it moves beyond the plane on which the wrapping sheet lies, i.e., the plane at which the sheet is arranged to start the packaging cycle.

The dimension of the wrapping sheet and the dimension of the group of products are such that flaps of the wrapping sheet, wrapped around the group of products, protrude with respect to the group of products from each of the aforesaid two opposite surfaces. The method further provides the step of folding the flaps of the wrapping sheet against the two opposite surfaces of the group of products so as to complete wrapping of the group of products in the wrapping sheet.

To prevent or reduce creases or erroneous positioning of the wrapping sheet with respect to the group of products to be packaged, the flaps of the wrapping sheet protruding from the group of products are supported, by means of mechanical support members, during at least a part of the relative movement between the group of products and the wrapping sheet.

In this way the tendency of the wrapping sheets towards skewing, folding or forming creases during the wrapping step is reduced. The speed at which the aforesaid steps of the packaging cycle are performed can also be carried out at high speed, due to the support with which the wrapping sheet is provided.

It has surprisingly been discovered that simply by supporting the flaps of wrapping sheet protruding from the two opposite surfaces left free before folding of the flaps even on only one side of the group of products, very effective control of the wrapping sheet is achieved, with the possibility of greatly increasing the production speed without negative consequences in terms of quality of the finished product.

In particularly advantageous embodiments, the support members act on a face of the wrapping sheet facing the group of products, providing a support that reduces the possibility of the wrapping sheet to fold downward.

The group of products can be positioned on an elevator, movable along a lifting and lowering trajectory with respect to the plane on which the wrapping sheet is spread. The plane is preferably approximately orthogonal to the lifting and lowering trajectory of the elevator.

The step of temporarily supporting the flaps of the wrapping sheet protruding from the group of products can comprise the steps of: arranging support members on at least one side of the group of products; and moving the support members in synchronism with the movement of the elevator toward the wrapping sheet. This means that the movement of the support members is coordinated in time with the movement of the elevator. However, it is not necessary for the support members and the elevator to perform identical movements. On the contrary, as will be described in detail with reference to the accompanying drawings, in general the stroke performed by the elevator can be longer than the stroke performed by the support members. These latter can, for example, rise together with the elevator performing a movement substantially coordinated with the movement of the elevator, for a first stroke. Thereafter, the elevator continues to rise while the support members come to the end of their stroke and return to the original position.

In practical embodiments, the support members are moved with a translation movement approximately parallel to the lifting and lowering movement of the elevator.

In some embodiments, the wrapping sheet has a substantially rectangular shape with a first side and a second side. The first side has a length given by the sum of: a) the dimension of the group of products to be packaged in a direction orthogonal to the aforesaid opposite surfaces that, in the first step of the packaging cycle, remain uncovered; b) the dimension of each flap protruding from the respective surface left uncovered. The second dimension of the wrapping sheet is advantageously greater than the extension of the lateral surfaces of the group of products to be packaged, so that two parallel edges of the wrapping sheet can be overlapped to be joined, for example by gluing or welding, forming a tubular structure that wraps the group of products laterally.

The flaps form two sections of the tubular structure that protrude from the opposite surfaces of the group of products.

These flaps are folded, in a subsequent step, against the respective faces left free, to close the package completely. The flaps can be folded with stationary or movable folding members.

Subsequently, the package is completed by stabilizing the folded flaps, for example by welding, gluing or the like.

In practical embodiments, once the group of products has been wrapped on three faces by the wrapping sheet, the two edges of the wrapping sheet intended to be joined to each other to form the tubular structure can be overlapped by means of two folding planes, for example in a step in which the elevator is being lowered. The partially formed package can be advanced, for example in a direction orthogonal to the direction of movement of the elevator, through a folding station and through a welding station, or more generally, a station for stabilizing the flaps folded to close the package.

In advantageous embodiments, in the initial steps of the wrapping cycle, the group of products to be packaged can be positioned on an elevator, between two mutually parallel walls extending vertically from a position of receiving the group of products, to a position of moving the products away. To center the group of products correctly on the elevator, an abutment wall, also vertical and orthogonal to the two lateral walls, can be provided.

The lateral walls can have slits for the passage of the wrapping sheet. For example, each lateral wall can consist of a lower wall and an upper wall, spaced from each other to form a slit into which the wrapping sheet is inserted.

The wrapping sheet can be arranged on the initial plane, for example retaining two parallel edges by means of flexible feeding and retaining members, for example two pairs of endless conveyor flexible members, for example formed of belts. The flexible members form a device for spreading the wrapping sheet substantially on a plane. It would also be possible to provide different devices for spreading the wrapping sheet, for example a frame or a pair of bars, equipped with suction holes to retain at least two parallel edges of the wrapping sheet. Other embodiments can provide different retaining means of the wrapping sheet, for example electrostatic or mechanical systems. In some embodiments the device for spreading the wrapping sheet can comprise grippers that engage and draw the wrapping sheet, by unwinding it from a reel, combined with retaining members of at least two opposite edges of the wrapping sheet, adapted to temporarily hold the wrapping sheet lying on a geometrical plane (i.e., not formed of a physical supporting surface) that is preferably arranged in an approximately horizontal position.

The support members of the wrapping sheet can move from a position approximately flush with the aforesaid slits for inserting the wrapping sheet, to a position above these slits, but advantageously below the final position that will be taken by the upper surface of the group of products. These, lifted by means of the elevator, will be positioned at a height higher than the maximum height reached by the support members and, in this lifting movement, will detach the wrapping sheet from the retaining members, for example belts or other flexible members, which retain the opposite edges of the wrapping sheet before it comes into contact with the group of products to be packaged.

In advantageous embodiments, each group of products to be packaged is lifted by the elevator to a conveyor device.

This comprises a number of compartments, arranged in sequence, each of which receives a group of products to be packaged with the related wrapping sheet wrapped around three of the four lateral faces of the group of products to be packaged. When the group of products is in the respective compartment of the conveyor device, the elevator can be lowered and the two edges of the wrapping sheet can be overlapped and welded or glued, to form the tubular structure that wraps the group of products laterally.

According to another aspect, there is provided a machine for packaging groups of products in a wrapping sheet. The machine comprises a device for spreading a wrapping sheet, typically on a plane. The machine further comprises a handling device, adapted to reciprocally move a group of products to be packaged and the wrapping sheet, so as to wrap the wrapping sheet around the group of products as a result of the movement between the wrapping sheet and the group of products. Advantageously, the machine further comprises temporary support members comprising mechanical members adapted to support flaps of the wrapping sheet protruding from the group of products during a phase of reciprocal movement between the group of products to be packaged and the wrapping sheet.

The temporary support members can advantageously be adapted to act on the surface of the wrapping sheet facing the group of products to be packaged.

The handling device can comprise an elevator provided with a lifting and lowering movement with respect to the wrapping sheet, preferably a movement substantially orthogonal to the plane on which the wrapping sheet is spread.

In some embodiments, the support members comprise a first support and a second support, mutually aligned and positioned on one side of the elevator, in a position such as to protrude from opposite surfaces of the group of products positioned on the elevator. The reciprocal distance and the position of the support members can be adjustable to adapt to groups of products of different shapes and dimensions to each other.

The machine can comprise a first actuator adapted to control the movement of the elevator and a second actuator adapted to control the movement of the support members.

In advantageous embodiments, the machine comprises, in a position above the plane on which the wrapping film is spread, a conveyor device, configured with a plurality of compartments adapted to receive groups of products to be packaged, together with the respective wrapping sheets partially wrapped around the group of products. In practice, the conveyor device is placed above the elevator, and is positioned to receive from the elevator the single groups of products partially wrapped in the wrapping sheet. Folding planes can be provided along the lifting path of the groups of products, which fold the wrapping sheet under the respective group of products, overlapping two edges of the wrapping sheet to produce a tubular wrapping structure of the group of products. The conveyor device can be configured to advance each group of products, wrapped in the tubular structure formed by the wrapping sheet, between folding members that fold flaps of the wrapping sheet against opposite surfaces of the group of products, and through a station for closing the package, for example by means of welding.

The support members can be carried by a bar or other moving member, placed on one side of the trajectory taken by the elevator on which the groups of products to be packaged are arranged. For example, the support members can be placed on the side of the trajectory of the elevator, from which the groups of products, partially wrapped in the wrapping sheet, are moved away by the conveyor device.

Further features and embodiments of the machine and of the method of the present description will be illustrated below and defined in the appended claims, which form an integral part of the present description.

BRIEF DESCRIPTION OF THE DRAWINGS

The invention will be better understood following the description and the accompanying drawings, which illustrate a non-limiting example of embodiment of the invention. More in particular, in the drawing.

DETAILED DESCRIPTION

Before describing in detail an exemplary embodiment of the packaging machine and of the related packaging method, with initial reference to the sequence of FIGS. 8A-8G the cycle of wrapping a group G of products R in a wrapping sheet F will be described. In the example illustrated, the products to be packaged are rolls R of paper, for example tissue paper. The rolls R can be rolls of toilet paper, kitchen towels or similar. However, as will be understood by those skilled in the art from the following description, innovative aspects of the method and of the packaging machine described herein can be used advantageously also to wrap other products, different from the rolls of tissue paper to which specific reference will be made in the present description, for example paper napkins or paper handkerchiefs.

A package C (FIG. 8G) is obtained starting from a wrapping sheet F (FIG. 8A) and a group G of products R suitably ordered according to a given geometric arrangement. In the illustrated example, the rolls R are arranged according to two layers of rolls, each of which contains four rows of rolls R. Each row has a plurality of rolls, for example four rolls. It must be understood that the number of layers, the arrangement and the number of rolls, or other products to be packaged, are not binding and are provided purely by way of example.

Figure 8A:
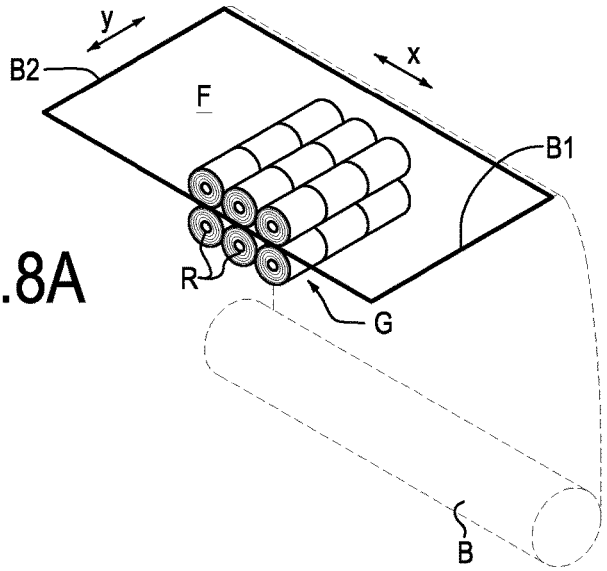
FIGS. 8A to 8G show a sequence of the packaging operations, in which only the group of products and the respective wrapping sheet are visible, to illustrate the steps of the cycle for wrapping the group of products in the wrapping sheet.

In general, the wrapping sheet F is arranged along a plane, as shown in FIG. 8A. This means that the wrapping sheet F is held spread flat so as to take an approximately planar form, which however is only approximate as, for example, also due to the weight thereof, the wrapping sheet F may be arranged in a manner that is not perfectly flat.

The wrapping sheet F can be a portion of a paper or plastic, i.e., polymer, film unwound from a reel B, shown indicatively with a dashed line in FIG. 8A. The way in which the wrapping sheet F is unwound and separated from the reel B is known and does not require further description.

The group G of products R to be packaged is placed in front of the wrapping sheet F. In the illustrated example, the group G of products R to be packaged is placed under the wrapping sheet F. The group G of products R to be packaged can be placed on an elevator, not shown in the sequence of FIGS. 8A-8G, but described below with reference to FIGS. 1 to 7.

The wrapping sheet F has two edges B1, B2 that will be overlapped and glued or welded to each other, to wrap the group G of products R laterally, forming a tubular winding around this latter.

Figure 8B:
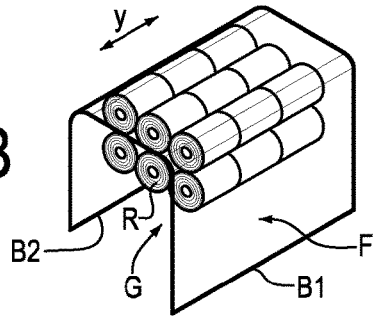

To package the group G of products R, in a first step of the packaging cycle the wrapping sheet F and the group G of products R are moved one with respect to the other according to a direction substantially orthogonal to the plane on which the wrapping sheet F is arranged in FIG. 8A. As can be seen in FIG. 8B, this relative movement causes wrapping of the wrapping sheet F around three lateral faces of the group G of products R. The dimension of the wrapping sheet F in the direction X (FIG. 8A) is such that the two edges B1, B2 of the wrapping sheet F are located under the lower face of the group G of products R. Preferably, the wrapping sheet F is not centered with respect to the group G of products R in the direction X, so that the sheet F protrudes with respect to the group G of products R to a greater extent on the side of the edge B1 than of the edge B2.

Figure 8C:
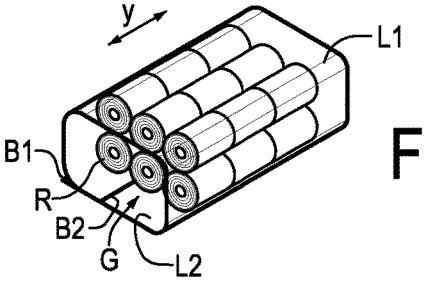
Figure 8D:
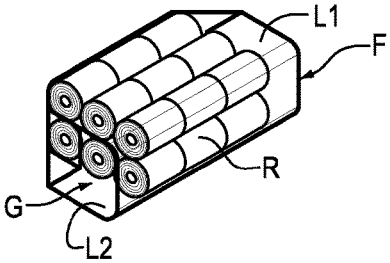
Figure 8E:
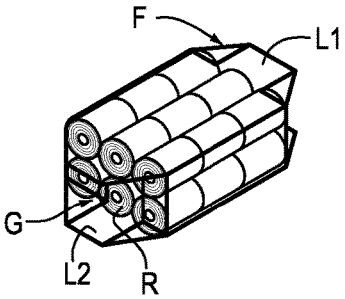
Figure 8F:
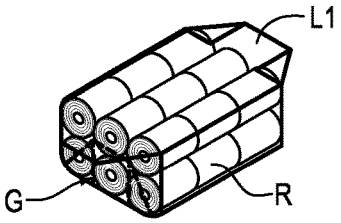

In practice, the dimension in direction X of the wrapping sheet F (which preferably is rectangular in shape) is greater than the sum of the dimensions of the four lateral faces of the group G of products R, so that the group G of products R can be completely wrapped on the four lateral faces causing the edges B1 and B2 to overlap slightly when the wrapping sheet F is wrapped around the lower face of the group G of products R, as visible in FIG. 8C. In this condition the two edges B1, B2 are mutually overlapped and can be glued or welded, to form with the wrapping sheet F a sort of tube around the group G of products R.

In the direction Y the wrapping sheet F has a dimension larger than the plan dimension of the group G of products R in the same direction Y. In this way, as can be seen in FIG. 8C, the wrapping sheet F protrudes with flaps L1 and L2 from two mutually opposite faces (frontal and rear) of the group G of products R. These two opposite faces are for the moment free, while the four lateral faces are wrapped by the wrapping sheet F arranged in tubular form around the group G of products R.

Figure 8G:
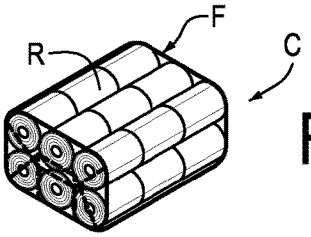

With subsequent folding operations, illustrated in the sequence of FIGS. 8D, 8E, 8F, 8G, the two flaps L1 and L2 are folded against the two opposite surfaces of the group G of products R, until obtaining the final package (FIG. 8G). The folded flaps L1, L2 can be stabilized by welding, or gluing, or by applying an adhesive sheet to the folded portions of the wrapping sheet F.

It has been found in practice that in the steps illustrated in FIGS. 8A, 8B, the wrapping sheet F can tend to form creases, folds or be positioned incorrectly with respect to the group G of products R. In particular, the wrapping sheet F can tilt so that any wording or other elements printed on the wrapping sheet F are no longer correctly positioned with respect to the geometric faces of the group G of products R. It is also possible that in the step in which the group G of products R comes into contact with the wrapping sheet F and is lifted relative thereto, one or both flaps L1, L2 of the wrapping sheet F, protruding with respect to the opposite faces of the group G of products R fold downward, above all in the corner area of the wrapping sheet F formed with the edge B1.

These phenomena result in a defective product, which might not be packaged correctly. For example, incorrectly folded lateral flaps L1, L2 can give rise to incomplete closing of the group G of products R, or to the formation of creases on the final package. These defects can occur more frequently as the production speed increases, as this leads to an increase of the speeds of all the movements of the group G of products R and of the wrapping sheet F.

To prevent or reduce the occurrence of defects in the finished package C, especially at high production rates, the method described herein provides for supporting the flaps L1, L2 during at least the first step of mutual contact and movement between products R and wrapping sheet F. All this will be more apparent from the description below of FIGS. 1 to 7, in which reference will initially be made to the structure of a packaging machine according to the present invention and subsequently to its operating cycle.

Figure 1:
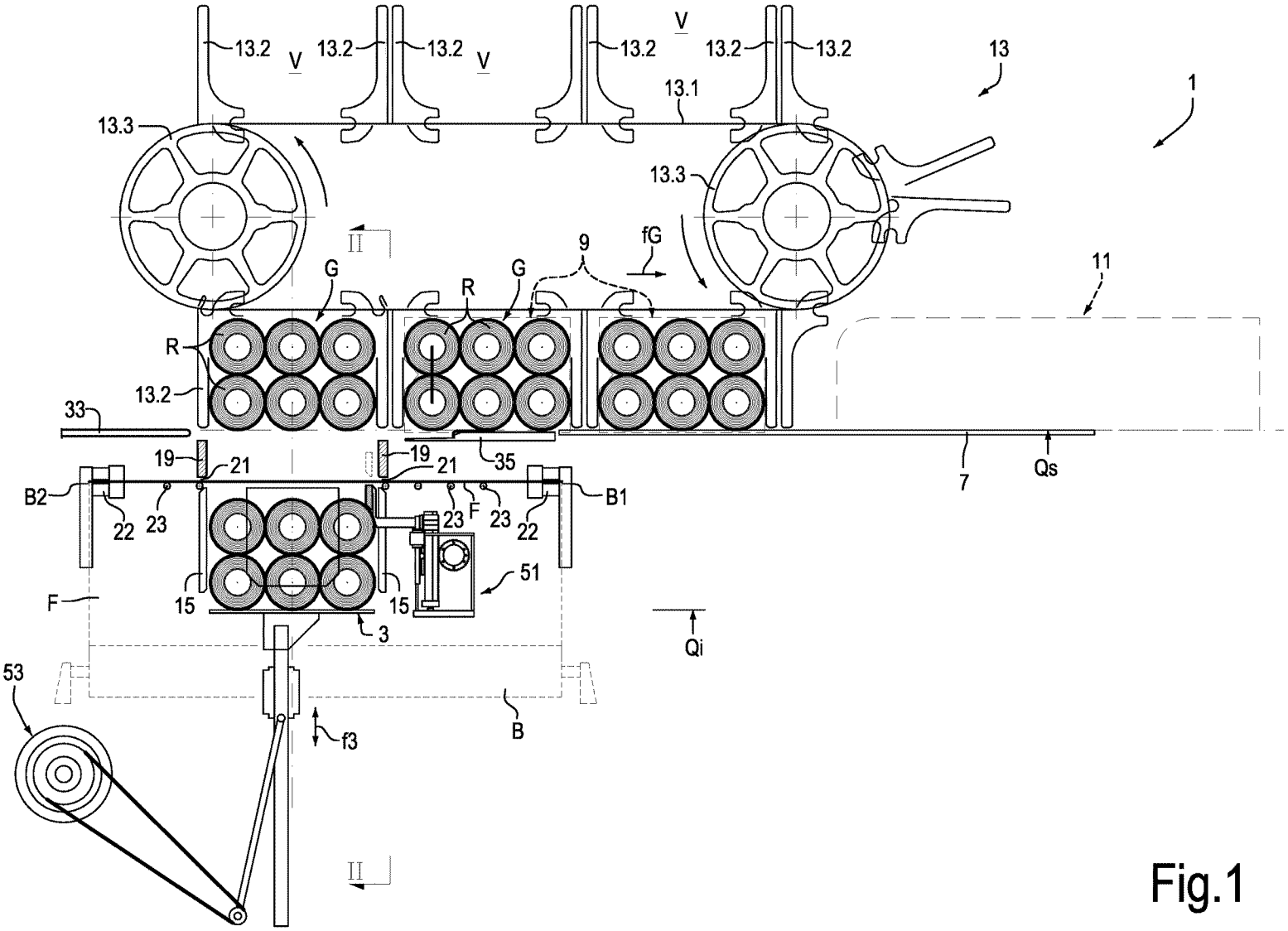
FIG. 1 shows a diagram of a packaging machine in a view according to the direction of arrival of the products to be packaged.
Figure 2:
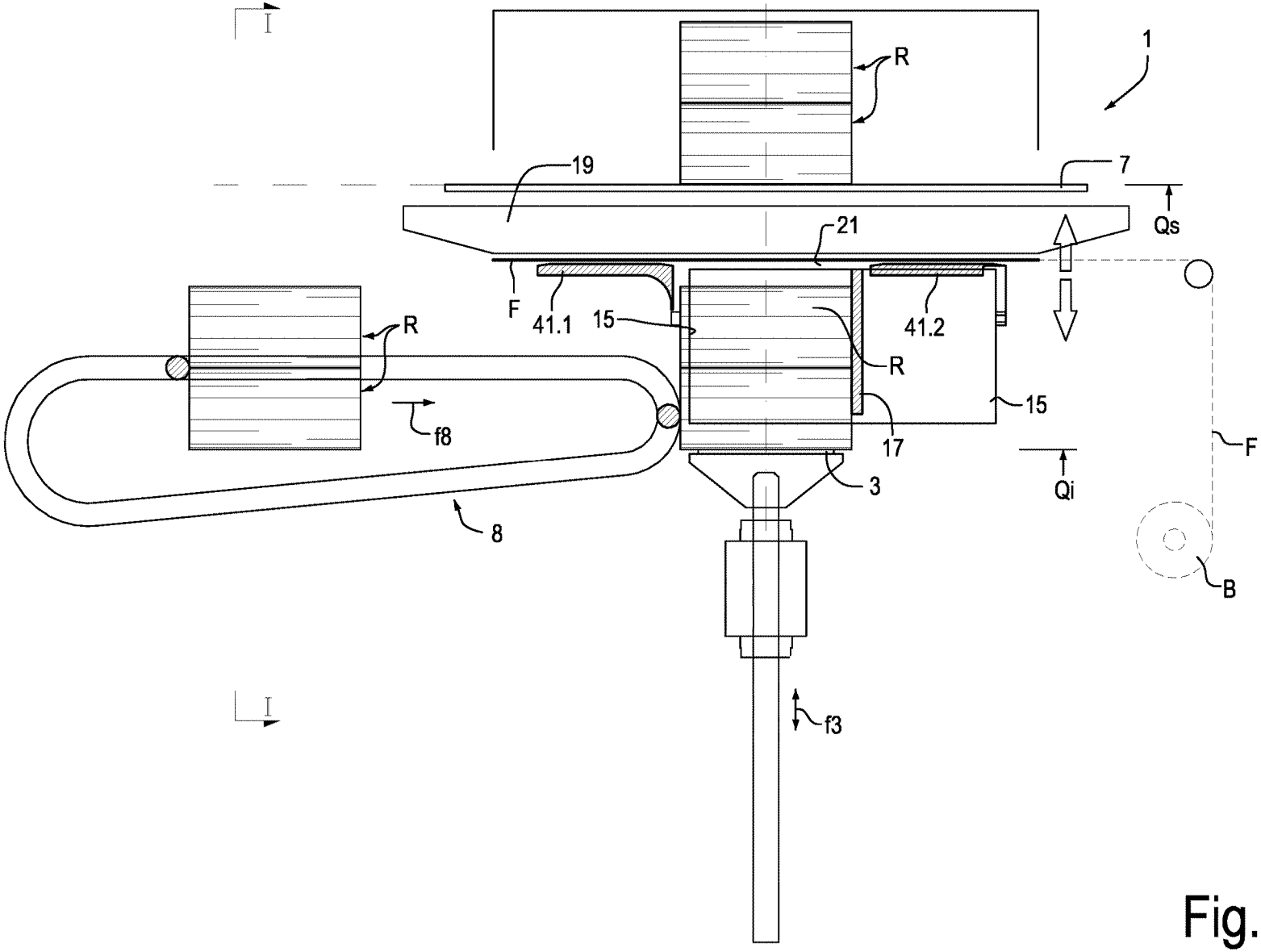
FIG. 2 shows a view along the line II-II of FIG. 1, with parts removed.

FIG. 1 illustrates a schematic view, according to the arrow I of FIG. 2, of a packaging machine 1 in which the invention can be implemented. The general structure of the machine 1 is known per se and greater details on the various possible embodiments are disclosed in the patent publications mentioned in the introduction of the present description. General features of the packaging machine 1, useful for understanding the invention, as well as details of embodiments of the innovative components, will be described below.

The packaging machine 1 comprises an elevator 3 provided with a movement according to a substantially vertical direction indicated with the double arrow f3. The elevator 3 has the function of lifting groups G of products R from a lower height Qi, at which the products are fed from a feed assembly 8 (FIG. 2), to an upper height Qs, at which a sliding plane 7 is located, along which the groups G of products R advance to complete the packaging cycle and obtain the finished package C (FIG. 8G).

As is known per se, the feed assembly 8 can arrange a variable number of layers of products R (two in the example of FIGS. 8A-8G) on the elevator 3, inserting them with a movement according to arrow f8 (FIG. 2). Once the groups G of products R have reached the upper height Qs, they advance according to the arrow fG along the sliding plane 7 through a folding assembly 9 and a welding assembly 11. The advance of the groups G of products R according to the arrow fG is obtained by means of a conveyor assembly or device 13, which comprises flexible members 13.1, to which teeth 13.2 are constrained. These latter define compartments V for receiving and advancing the groups G of products R. The flexible members 13.1 are guided around guide wheels 13.3, suitably motorized to move the flexible members 13.1, and hence the teeth 13.2, along a closed path. The active branch of the closed path is the lower branch, at which the groups G of products R are inserted into the compartments V and are advanced according to the arrow fG.

Each group G of products R is inserted or formed on the elevator 3 between a pair of lateral walls 15 and an end abutment wall 17 (FIG. 2). The position and the mutual distance between the two lateral walls 15 can be adjusted as a function of the dimension and of the shape of the group G of products R, in a manner known per se. Also the position of the abutment wall 17 can be adjusted as a function of the aforesaid features of the group G of products R, so that the group G of products R can be arranged in an ordered manner and the products R can be maintained in the correct position for the subsequent packaging operations.

As can be seen in FIGS. 1 and 2, guide walls 19 are arranged above the lateral walls 15. Advantageously, the guide walls 19 can be aligned vertically to the lateral walls 15. The lower edges of the guide walls 19 form, with the upper edges of the lateral walls 15, two slits 21 for inserting and positioning a wrapping sheet F.

The wrapping sheet F is unwound from the reel B, schematically shown in FIG. 1, and passes through the slits 21. In advantageous embodiments, the wrapping sheet F is conveyed by belts or other feed members 22, which engage the edges B1, B2 (FIG. 8A) of the wrapping sheet F and unwind it on a substantially horizontal geometrical plane, passing through the two slits 21. The feed members form (or form part of) a device for spreading the wrapping sheet F.

To support the wrapping sheet F in an approximately flat arrangement, supporting elements 23 can be provided, for example in the form of bars extending parallel to the edges B1, B2 of the wrapping sheet F spread flat and extending through the slits 21.

When a group G of products R has been arranged on the elevator 3, this is lifted (arrow f3) until the group G of products R is carried to the upper height Qs at which the sliding plane 7 is located, inserting it into one of the compartments V defined by the teeth 13.2 of the conveyor assembly 13. In the lifting movement, the group G of products R is partially wrapped by the wrapping sheet F, as shown in the sequence of FIGS. 8A, 8B described above. Once the group G of products R has been inserted into the respective compartment V of the conveyor assembly 13, it advances according to the arrow fG through the folding assembly 9 and the welding assembly 11. Passing between the guide walls 19, the group G of products R engages the wrapping sheet F causing it to be arranged around the lateral faces and the upper face of the group G of products R, taking the position of FIG. 8B.

Two lower folding members 33, 35 are arranged approximately at the level of the sliding plane 7, and move horizontally toward each other to fold the wrapping sheet F under the group G of products R and overlap the edges B1, B2, while the elevator 3 returns to the lower height Qi.

Figure 3:
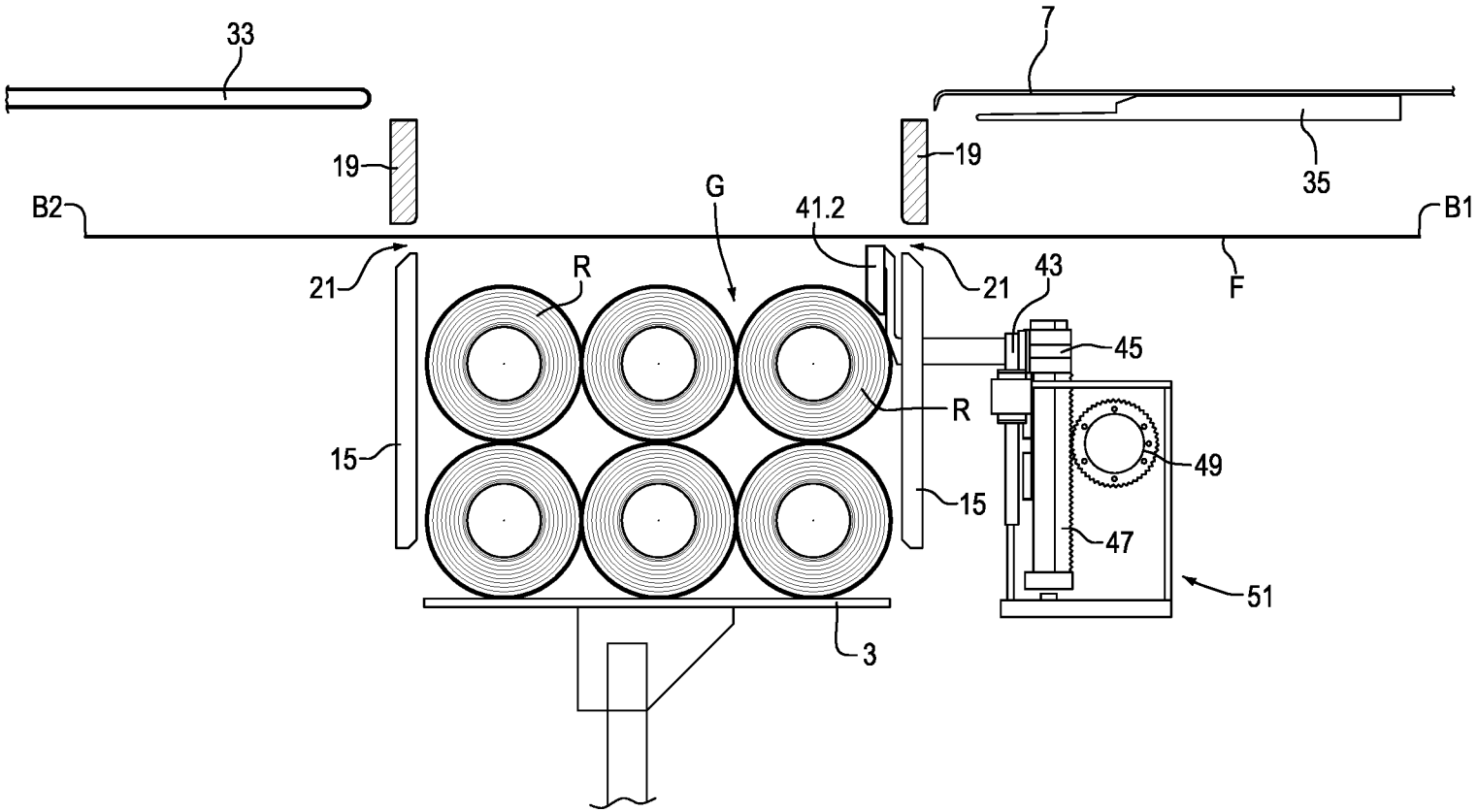
FIGS. 3, 4, 5 and 6 show a sequence of movements of the elevator of the packaging machine in steps of the packaging cycle of a group of products.
Figure 4:
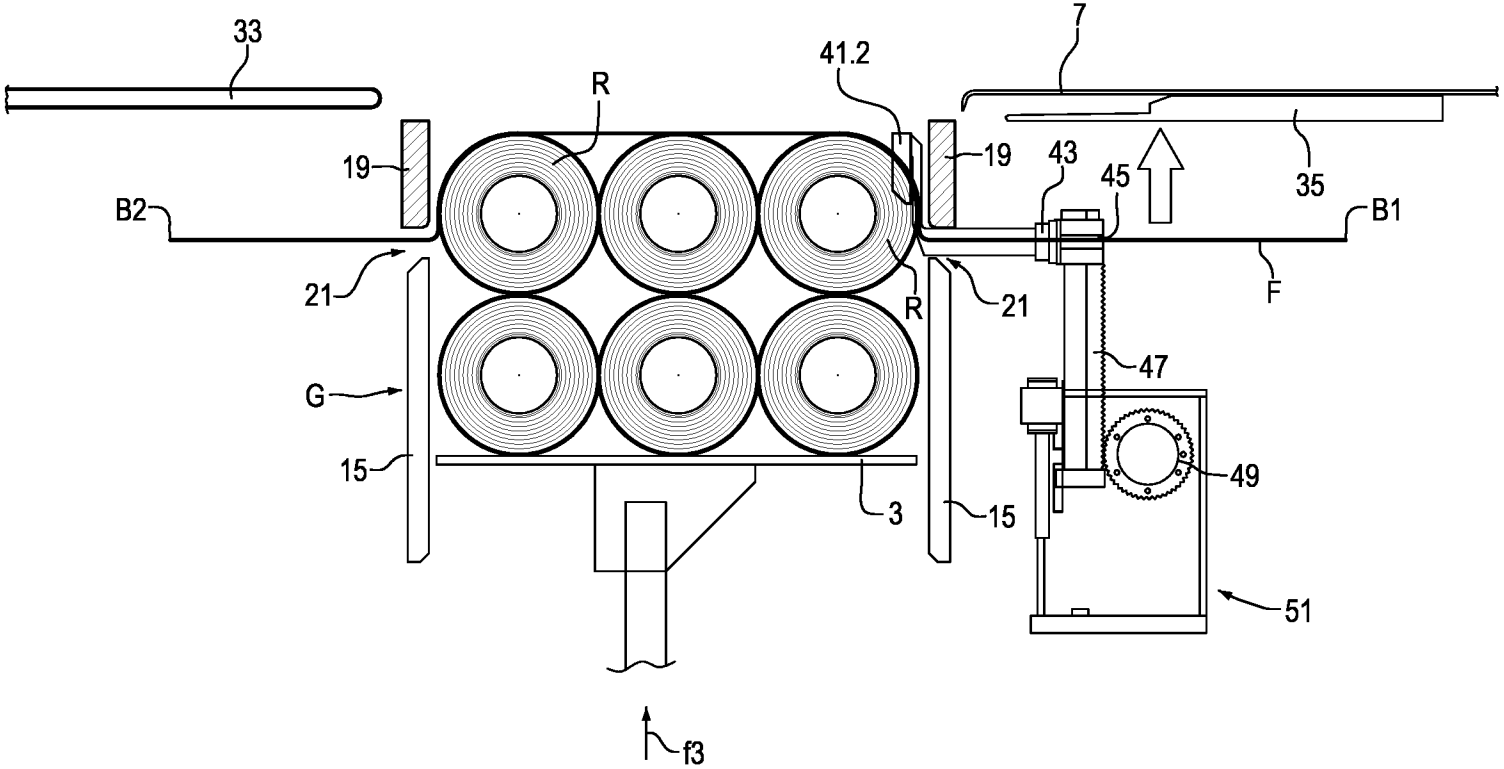
Figure 5:
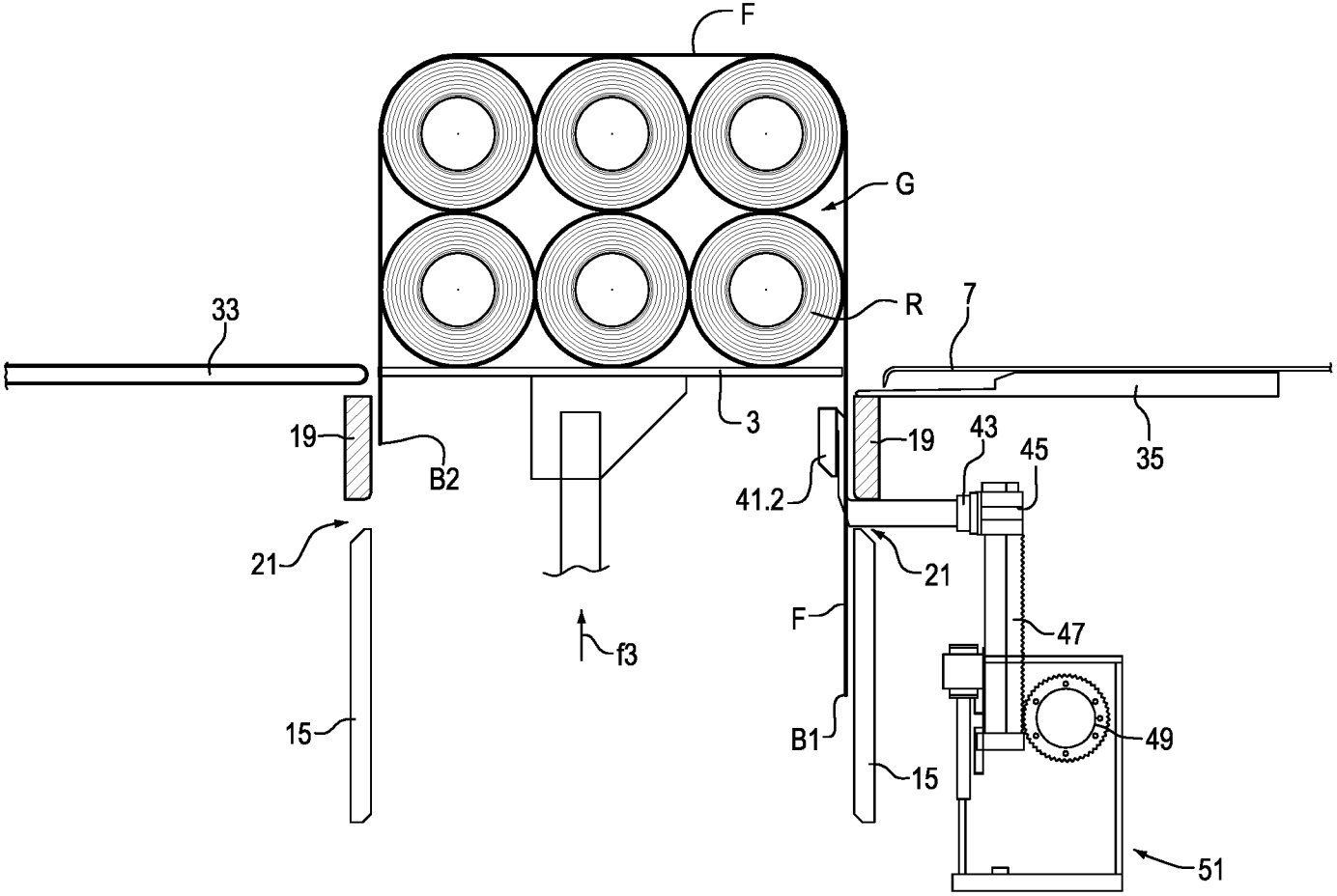
Figure 6:
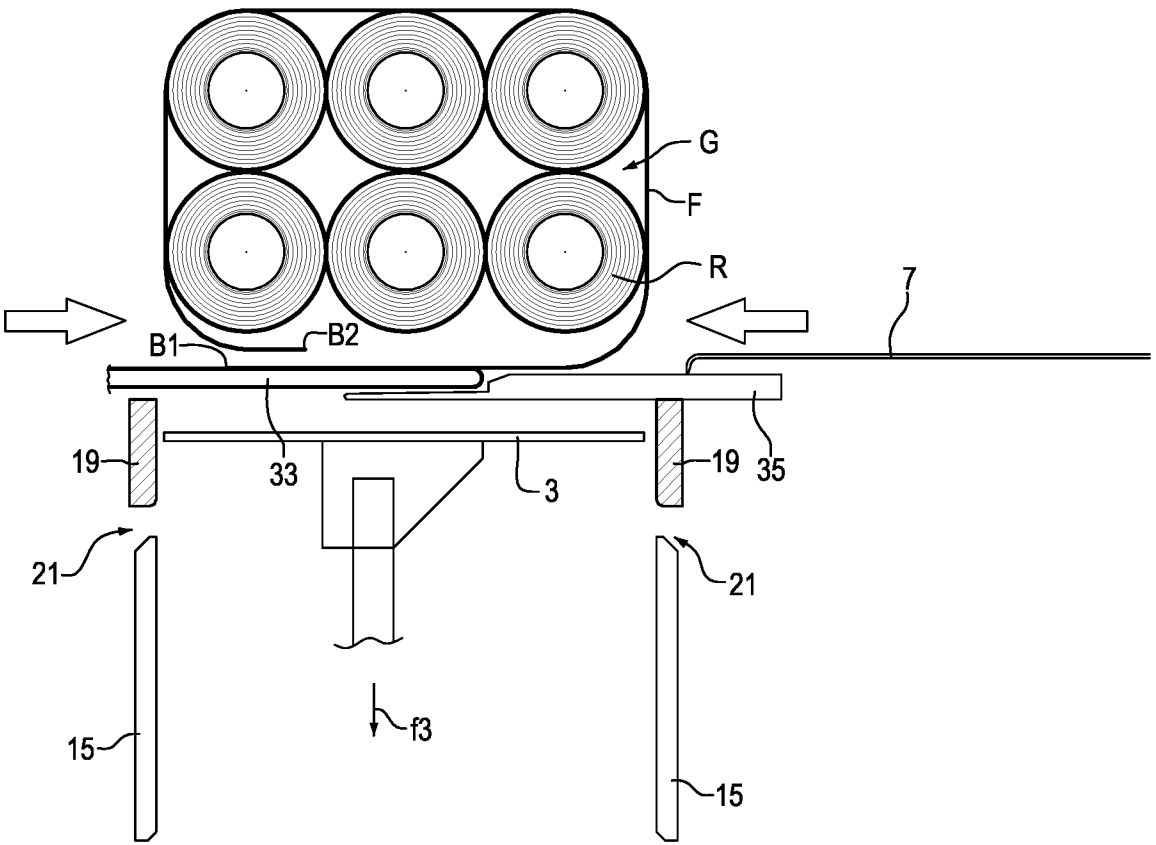

This sequence of steps is illustrated in greater detail in FIGS. 3, 4, 5 and 6. More in particular, in FIG. 3 the group G of products R is at the lower height Qi. In FIG. 4 the group G of products R comes into contact with wrapping sheet F, and the wrapping sheet F is wrapped around the upper face and the lateral faces of the group G of products R. In FIG. 5 the group G of products R is at the upper height Qs and in FIG. 6 the edges B1 and B2 have been mutually overlapped to complete wrapping of the lower face of the group G of products R. The elevator 3 is lowered toward the lower height Qi to pick up a new group G of products R to be packaged. In this step, the two opposite faces, front and rear, of the group G of products R are free, and the flaps L1, L2 (FIG. 8A-8G) of the wrapping sheet F protrude from the group G of products R approximately orthogonally to the opposite faces left free.

Passing from the step of FIG. 3 to the step of FIG. 4, the edges B1, B2 of the wrapping sheet F detach from the belts 22, as the wrapping sheet F starts to wrap the group G of products R. In this step there is greater risk of skewing of the wrapping sheet F, and a greater risk of the flaps L1, L2 (FIGS. 8A, 8B) being folded downward, in front of the opposite front faces of the group G of products R, giving rise to the problems discussed above.

Figure 7:
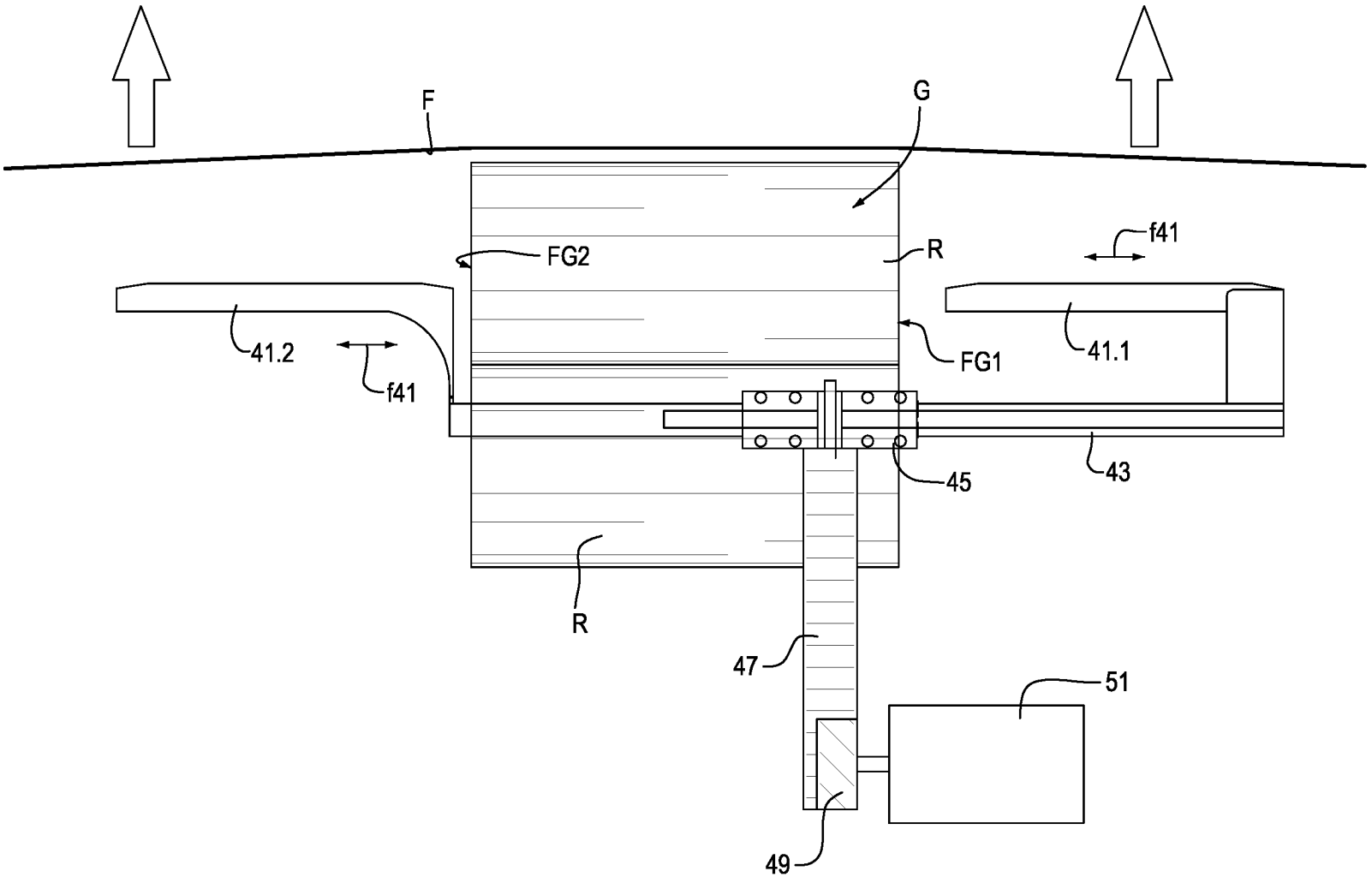
FIG. 7 shows, in a side view, a diagram illustrating in greater detail the function of the support members of the wrapping sheet in the initial step of lifting of the elevator of the packaging machine.

To reduce this risk, a pair of support members 41.1, 41.2, visible in FIGS. 3, 4, 5, 6 and in the side view of FIG. 7, is placed on at least one side of the group G of products R. More in particular, the support members 41.1, 41.2 are placed on the side of the group G of products R oriented toward the outlet of the packaging machine 1, i.e., toward the folding assembly 9. As is visible in particular in FIG. 7, the two support members 41.1 and 41.2 are placed outside the footprint of the group G of products R, i.e., outside two vertical planes containing the two opposite faces of the group G of products R that in this step have not yet been wrapped by the wrapping sheet F. In FIG. 7 these faces are indicated with FG1 and FG2. In practice, in FIG. 3 the two support members 41.1 and 41.2 are located below the portions of wrapping sheet F that protrude from the footprint of the group G of products R and which form the flaps L1, L2 that will protrude with respect to the group G of products R, when the latter is located at the upper height Qs.

As can be understood by comparing FIGS. 3, 4 and 5, the support members 41.1 and 41.2 follow the lifting movement of the elevator 3 and of the group G of products R in synchronism for a certain lifting stroke, which ends in the position of FIG. 4. At this stage, the wrapping sheet F has started to wrap around the vertical lateral surfaces of the group G of products R. The fold formed by the wrapping sheet F around the group G of products R gives the wrapping sheet F sufficient rigidity, so that, even when the support of the support members 41.1 and 41.2 is removed, the phenomenon of the flaps L1 and L2 falling downward no longer occurs.

In practice, after reaching the position of FIG. 4, the elevator 3 can continue lifting the group G of products R, while the support members 41.1 and 41.2 can return to the initial position (FIG. 3).

FIG. 7 shows in a side view the lifting movement of the support members 41.1 and 41.2, and their overall stroke.

In some embodiments, the support members 41.1, 41.2 can be mounted on a bar 43 that engages with a sliding block 45. This latter can be integral with a rack 47 meshing with a pinion 49 rotated by an electric motor 51, schematically shown in FIG. 7. The electric motor 51 forms an actuator for lifting and lowering the support members 41.1 and 41.2, separate and independent from an actuator for operating the elevator 3. This second actuator is indicated schematically with 53 in FIG. 1.

The described configuration of the control members for controlling the movement of the support members 41.1, 41.2 is particularly advantageous, but is not binding.

With the arrangement described the following is obtained. When the group G of products R touches the wrapping sheet F and, as a consequence of the relative movement between the group G of products R and the wrapping sheet F, this latter is released from the belts 22, the support members 41.1, 41.2 form a support for the wrapping sheet F at least until it has been curved around the upper face of the group G of products R. During the step in which the flaps L1, L2 of the wrapping sheet F, which protrude beyond the footprint of the group G of products R, have a greater tendency to fold downward due to gravity and above all due to the inertial force caused by the upward acceleration imparted by the elevator 3, these flaps L1, L2 are supported on the support members 41.1, 41.2.

It must be understood that similar, albeit less efficient, effects can be obtained with other configurations of the support members. For example, they can have a rotation movement instead of a translation movement as illustrated in the drawings. In some embodiments, the support members can be constrained to the lateral walls 15, for example in a sliding or rotating manner.

In advantageous embodiments, the position of the support members 41.1 and 41.2 can be adjustable, to adapt to the dimension of the group G of products R. In general, as is known, when the dimension of the group G of products R changes, the walls 15, 17, 19 are positioned so that the centerline of the group G of products R always remains in the same position with respect to the packaging machine 1 and consequently with respect to the elevator 3 and with respect to the conveyor assembly 13. With reference to FIG. 7, the position of support members 41.1 and 41.2 can be adjusted according to the arrows f41, for example by means of suitable guide systems along the beam 43. In some embodiments, it is also possible for the support members 41.1, 41.2 to be interchangeable or adjustable in length, to adapt to the variable dimensions of the wrapping sheet F, in particular when the dimension Y (FIG. 8A) varies, without interfering with other members of the packaging machine, for example the abutment wall 17.

The invention claimed is:

1. A machine for packaging groups of products in a wrapping sheet, comprising a device for spreading a wrapping sheet; and a handling device adapted to move a group of products to be packaged and the wrapping sheet with respect to one another, thus wrapping the wrapping sheet around the group of products due to a reciprocal movement between the wrapping sheet and the group of products; and temporary support members adapted to support flaps of the wrapping sheet protruding from the group of products during a phase of reciprocal movement between the group of products to be packaged and the wrapping sheet;

wherein the temporary support members comprise mechanical members adapted to support from below flaps of the wrapping sheet which protrude from a group of products supported on the handling device and act on a surface of the wrapping sheet facing the products to be packaged.

2. The machine of claim 1, wherein the handling device comprises an elevator provided with a lifting and lowering movement with respect to the wrapping sheet.

3. The machine of claim 2, wherein the temporary support members are provided with a lifting and lowering movement synchronized with the movement of the elevator.

4. The machine of claim 2, wherein the support members comprise a first support and a second support aligned with one another and positioned on one side of the elevator, in a position so as to protrude from opposite surfaces of the group of products positioned on the elevator.

5. The machine of claim 4, wherein the first support and the second support are adjustable in position with respect to a position of the elevator.

6. The machine of claim 2, further comprising a first actuator adapted to control the movement of the elevator and a second actuator adapted to control the movement of the support members.

7. A machine for packaging groups of products in a wrapping sheet, comprising a device for spreading a wrapping sheet; and handling device adapted to move a group of products to be packaged and the wrapping sheet with respect to one another, thus wrapping the wrapping sheet around the group of products due to a reciprocal movement between the wrapping sheet and the group of products; and temporary support members adapted to support flaps of the wrapping sheet protruding from the group of products during a phase of reciprocal movement between the group of products to be packaged and the wrapping sheet;

wherein the temporary support members comprise mechanical members adapted to act on a surface of the wrapping sheet facing the products to be packaged, wherein the handling device comprises an elevator provided with a lifting and lowering movement with respect to the wrapping sheet, wherein the temporary support members are provided with a lifting and lowering movement synchronized with the movement of the elevator, wherein the support members are controlled to perform a stroke synchronized with an initial phase of the movement in which the elevator moves toward the wrapping sheet, the stroke of the support members being shorter than the stroke performed by the elevator, with respect to the wrapping sheet.

8. A machine for packaging groups of products in a wrapping sheet, comprising:

a device for spreading a wrapping sheet;

a handling device adapted to move a group of products to be packaged and the wrapping sheet with respect to one another to wrap the wrapping sheet around the group of products due to reciprocal movement between the wrapping sheet and the group of products; wherein the handling device comprises an elevator provided with a lifting and lowering movement;

temporary support members adapted to support flaps of the wrapping sheet protruding from the group of products during a phase of the reciprocal movement between the group of products to be packaged and the wrapping sheet;

wherein the temporary support members comprise mechanical members adapted to act on the surface of the wrapping sheet from below the wrapping sheet; and wherein the temporary support members are provided with a lifting and lowering movement synchronized with an initial phase of movement of the elevator as the elevator moves toward the wrapping sheet, and during the initial phase of said movement, the flaps of the wrapping sheet projecting laterally from the group of products are supported by said temporary support members.

* * * * *